US007182828B2

(12) United States Patent
Zirker

(10) Patent No.: US 7,182,828 B2
(45) Date of Patent: Feb. 27, 2007

(54) ACRYLIC PAINT MONOTYPE ARTWORK

(76) Inventor: Irving Joseph Zirker, 451 O'Connor St., Menlo Park, CA (US) 94025

( * ) Notice: Subject to any disclaimer, the term of this patent is extended or adjusted under 35 U.S.C. 154(b) by 0 days.

(21) Appl. No.: 10/855,005

(22) Filed: Dec. 1, 2003

(65) Prior Publication Data

US 2005/0000637 A1 Jan. 6, 2005

Related U.S. Application Data

(63) Continuation-in-part of application No. 10/005,994, filed on Nov. 7, 2001, now Pat. No. 6,663,143.

(60) Provisional application No. 60/251,467, filed on Dec. 4, 2000.

(51) Int. Cl.
*B44C 1/16* (2006.01)

(52) U.S. Cl. ..... 156/230; 156/247; 156/307.5; 156/63

(58) Field of Classification Search ..... 156/230–241, 156/247, 277, 289; 427/146–148; 428/40.1, 428/41.9, 42.1–42.5, 195.1–210, 914
See application file for complete search history.

(56) References Cited

U.S. PATENT DOCUMENTS 3,928,710 A * 12/1975 Arnold et al. ..... 156/240
4,037,008 A * 7/1977 Tugwell ..... 156/240
4,434,198 A * 2/1984 Clark ..... 428/43
4,980,224 A * 12/1990 Hare ..... 156/240
5,985,079 A * 11/1999 Ellison ..... 156/244.23

* cited by examiner

*Primary Examiner*—Melvin Mayes
*Assistant Examiner*—Kim McClelland
(74) *Attorney, Agent, or Firm*—Robert O. Guillot; Intellectual Property Law Offices

(57) ABSTRACT

An artwork is made on a surface of a matrix or plate with acrylic paint and then allowing the paint to dry. A layer of a backing material adhesive, such as an acrylic gel, is next applied to the acrylic layer and a backing material (such as paper or cloth) is placed upon the gel, and the wet gel is then allowed to dry. The dry artwork is then removed from the matrix. The invention allows the inclusion within a single image of other media (wet or dry), such as paper, fabric, dry acrylic elements, watercolor, waterbase crayons and pencils, felt pens, waterbase inks, water mixable oil paints, oil pastels and oil paint sticks because of the bonding abilities of acrylics.

4 Claims, 3 Drawing Sheets

ACRYLIC PAINT MONOTYPE ARTWORK

CROSS-REFERENCE TO RELATED APPLICATION

This application is a continuation-in-part application of U.S. patent application Ser. No. 10/005,994 filed on Nov. 7, 2001 now U.S. Pat. No. 6,663,143, which claims priority to U.S. provisional application Ser. No. 60/251,467, filed Dec. 4, 2000, entitled Acrylic Paint Monotype Artwork.

BACKGROUND OF THE INVENTION

1. Field of the Invention

The present invention relates generally to methods for making a monotype artwork, and more particularly to the use of acrylic paint and pigments in the making of a monotype artwork.

2. Description of the Prior Art

By definition, a fine art monotype is an image rendered by hand on a support surface (referred to as a plate) and then, traditionally, transferred to paper under pressure of the etching press. It is incapable of being editioned because no permanent pattern is established on the plate surface. A monoprint method includes a monoprint plate which contains important elements of etched, engraved or cut lines and textures that, along with hand application of painted imagery allow for subsequent printings to exhibit identical marks while retaining a one-of-a-kind identity.

Most monotype artists are familiar with the traditional materials and methods used in their making. Suffice to say that oilbase pigments remain wet long enough to allow ample time before printing is necessary and that waterbase pigments are preferably printed after they dry being easily reactivated by dampened paper under pressure. In both cases the material birth of the traditional monotype depends on the pressure of the etching press, a Japanese baren, squeegee, spoon or some such device in order to wed pigments with paper. In the printing process the exposed top layer of the image is forever buried within the paper fibers while, simultaneously, the heretofore unseen bottom layer adhering to the plate is released disclosing the face of the plate mirrored within the content of the image.

In the use of acrylic pigments, media and gels in a monotype process, time becomes a significant issue due to a characteristic rapid rate of drying and polymerization. The usual approach to the making of acrylic monotypes, especially when formal demands require some degree of complexity, is to print segments of the composition, one at a time, before they dry. And while this strategy of joining and layering of parts does not preclude rich and unique pictorial solutions it does explain why the medium is not more favored by monotypists. Additionally, while oilbase and waterbase pigments allow for the printing of ghost images, acrylics, due to their rapid rate of drying, do not easily give up their ghosts. However, given the limitations, the very troubling drying characteristic constraining acrylic's easy use is transformed in this invention to an advantage simply by eliminating pressure as the transfer device and accepting acrylic's basic physical nature as a casting medium.

Most artists working with acrylics have, at one time or another, observed the ease with which the dried pigments peel from slick, non-absorbent surfaces such as glass or china plates used as palettes. What has not been associated with this phenomenon (acrylic's inherent peelability' and flexibility) is, in essence, a valuable clue pointing to a radical direction in the making of monotypes. That is, when acrylic is painted on a glass plate and then allowed to thoroughly dry it may be easily lifted off revealing its underside contact imagery. In other words, an acrylic monotype is made by working with the intrinsic physicality of the medium. This approach opens up a number of new possibilities in the way drawn, painted and collaged monotypes and assemblages can be made. In essence, what is proposed here is to make use of the way acrylic is transformed in its drying process becoming as it does a continuous polymerized, flexible and malleable film. Removal of such a paint film from a plate surface is, for all practical purposes, no different than the lifting of a cast from a mold. And, in addition to acrylic'natural casting attributes, it also acts as a bonding agent allowing for the inclusion of other materials and the use of other media.

In the proposed method acrylic paints, that may be modified by retardants, flow release liquid, acrylic media and gels, may be used separately or in combination with most other media such as oilbase and waterbase paints and inks, crayons, oil paint, sticks and markers in the creating of monotypes and monoprints.

SUMMARY OF THE INVENTION

The present invention involves the painting and/or drawing directly on a surface of a matrix or plate, such as a paraffin matrix or glass, china, polyethelene or zinc plates, with acrylics and then allowing the paint to dry completely before removing the image intact, as opposed to the traditional prior art method of printing the quick drying pigments in sections in layered sequence while the pigments are still wet. In the basic process an acrylic image is created on the matrix and allowed to dry. A layer of a backing material adhesive, such as an acrylic gel, is next applied and a backing material (such as paper or cloth) is placed upon the gel, and the wet gel is then allowed to dry. The dry artwork is then removed from the matrix. In various augmented embodiments, layers of applied acrylic pigments can be used as stopouts as well as compositional elements in that an applied layer not covering the whole the entire matrix surface when dry allows those vacant matrix areas to be painted with different color layers without disturbing the first layer. Also, any layer of acrylic pigment when dry can be worked with tools (stylus, fingernail, etc.) to remove dried pigment so that other layers of different color pigment may be applied in the exposed matrix areas.

Further, after its borders have been cut with a sharp blade, any section of any image painted with acrylic pigment, medium or gel can be lifted by hand so that it may be used as collage elements with the same image, a different image or to be stored for later use. These sections may be selectively pressed into place against the plate surface so that they appear as continuous visual elements in the context of the whole image. The invention allows the inclusion within a single image of other media (wet or dry), such as watercolor, waterbase crayons and pencils, felt pens, waterbase inks, water mixable oil paints, oil pastels and oil paint sticks because of the bonding abilities of acrylics. Additionally, all types of acrylic can be applied including Rhoplex, latex and latex enamel house paints and sprays. This invention includes the removal by hand of the resulting polymerized acrylic film from the matrix surface with or, if thick enough, without reinforcement of either paper or cloth backing material.

It is an advantage of the present invention that acrylic paints are utilized in the monotype artwork process.

It is another advantage of the present invention that a monotype artwork is produced that does not require the utilization of a press.

It is a further advantage of the present invention that a variety of media and elements can be incorporated within the acrylic paint monotype.

It is yet another advantage of the present invention that collage and intaglio prints can be made using the acrylic paint process.

These and other features and advantages of the present invention will no doubt become apparent to those skilled in the art upon reading the following detailed description which makes reference to the several figures of the drawings.

IN THE DRAWINGS

DETAILED DESCRIPTION OF THE PREFERRED EMBODIMENTS

Figure 1:
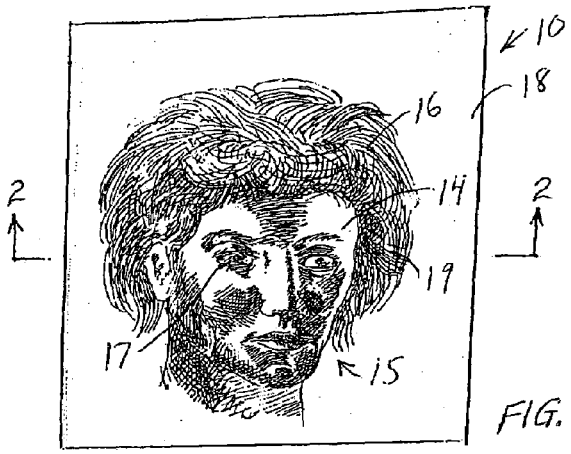
FIG. 1 is a top plan view of a process step of the present invention in which an artwork is created upon a matrix.
Figure 2:
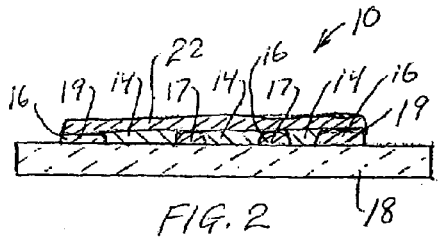
FIG. 2 is a cross-sectional view taken along lines 2—2 of FIG. 1.

FIG. 1 depicts a first step in the creation of an artwork 10 of the present invention utilizing acrylic paint 14 upon a surface of a matrix or plate 18 such as a thick piece of glass, and FIG. 2 is a cross-sectional view taken along lines 2—2 of FIG. 1. The artwork 10 of FIG. 1 is a facial portrait FIG. 15, and is primarily created with the first acrylic paint layer 14. Other materials 16 such as paper, fabric, watercolor, ink, oils, pastels, etc. may be applied next to or upon an acrylic paint area 14. For instance, the eyes 17, or perhaps the hair 19 or other features, of the FIG. 15 depicted in FIGS. 1 and 2 might be comprised of a fabric, oil paint or other elements 16, while the remainder of the FIG. 15 is comprised of the acrylic paint layer 14. Acrylic paint is selected for three reasons:

a. Acrylic paint dries quite rapidly.

b. When it dries it forms a plastic paint mass that strongly adheres to itself.

c. Acrylic paint does not strongly adhere to glass, polyethelene or zinc.

After the first acrylic (and other materials 16) layer 14 has dried, a second layer 22 may optionally be applied to the upper surface of the first layer 14, this time typically of acrylic only and allowed to dry. Thus, the acrylic layers 14 and 22 serve not only as a pigment but as a bonding agent as well, where the layer 22 bonds to the acrylic layer 14 and to the other materials 16. A variety of plate materials are acceptable such as zinc, glass and polyethelene sheets and china plates—the transparent plates being more practical since the artist can see the work in progress and in its actual orientation from the reverse side. Three dimensional surfaces can also be used as a matrix.

Figure 3:
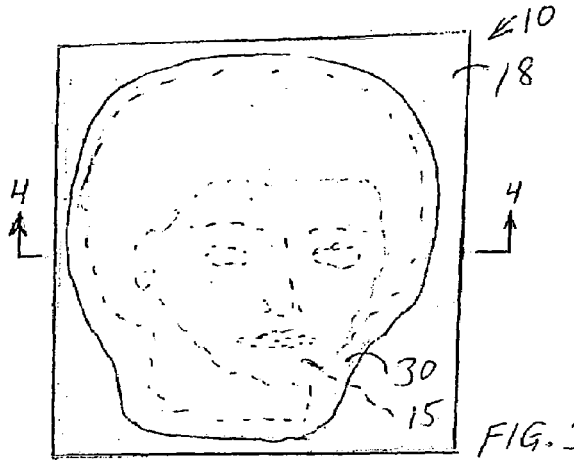
FIG. 3 is a top plan view depicting a further process step of the present invention in which an adhesive and a backing material have been applied to the artwork depicted in FIG. 1.
Figure 4:
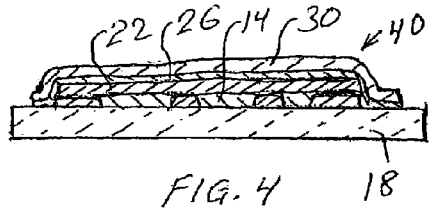
FIG. 4 is a cross-sectional view taken along lines 4—4 of FIG. 3.
Figure 5:
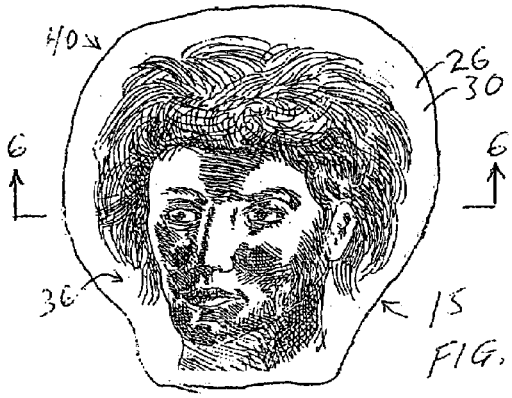
FIG. 5 is a top plan view depicting an artwork of the present invention as removed from the matrix.
Figure 6:
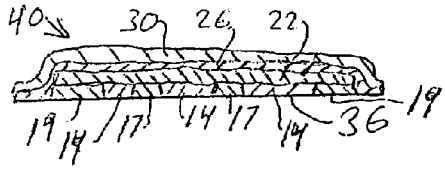
FIG. 6 is a cross-sectional view taken along lines 6—6 of FIG. 5.

As depicted in FIGS. 3 and 4, where FIG. 4 is a cross-sectional view taken along lines 4—4 of FIG. 3, after drying, the upper surfaces of the acrylic layers 14 and/or 22 are coated with acrylic gel 26 which serves as a backing material adhesion layer 26 for either a cloth or paper reinforcing backing material 30. The backing material 30 is pressed into place on the wet gel 26 by hand, brush and/or squeegee and allowed to dry. It is important that a good adhesive bond between the paper/canvas 30 and the upper surface of the artwork is formed utilizing the adhesive gel 26. After drying, the whole artwork 40 (paint layers, gel and backing) is easily peeled by hand from the plate surface 18, and FIGS. 5 and 6 are a depiction of the acrylic artwork now peeled from the plate and disposed upon the paper/canvas, where FIG. 6 is a cross-sectional view taken along lines 6—6 of FIG. 5. Interestingly, the image in FIG. 5 is reversed from that depicted in FIG. 1, and the front surface 36 of the artwork 40 is the paint surface that was formed in contact with the glass matrix surface 18. In the finished artwork depicted in FIGS. 5 and 6, the second layer 22 may be considered as applied to a rear surface of the first layer 14, and the backing material adhesion layer 26 may be considered as applied to the rear surface of the second layer 22.

Thus the present invention takes advantage of the dry acrylic image of FIGS. 1 and 2 by applying an adhesive gel 26 and backing material 30 (paper/canvas) to its upper surface such that the acrylic image then adheres to the paper/canvas when the adhesive gel is dry. A further significant feature of the acrylic paint is that it holds together when dry such that the entire artwork 40 that was created on the glass 18 is removed in a single piece by the application of the adhesive gel and backing material to the upper surface of the acrylic image. Additionally, all types of acrylic can be applied including Rhoplex, latex and latex enamel house paints and sprays. Another significant feature of the present invention is that the acrylic paint image does not adhere strongly to the glass surface, such that it pulls away from the glass 18 and is adhered to the paper/canvas backing material 30. By comparison, the present invention was attempted by applying acrylic paint on an acrylic plastic sheet in place of the glass sheet. The acrylic paint adhered to the acrylic plastic sheet and could not be successfully removed from it following the adhesion of the paper/canvas to the surface of the image.

As a matter of comparison between prior art printing processes and the casting type process of the present invention, it is instructive to note some principal differences. While printing pressure buries the top layer of pigment in the paper fibers and allows release of the bottom layer from the plate, the casting process allows the top pigment surface either to be exposed along with its bottom surface or to be covered with a reinforcing material such as paper or cloth. In the former casting process instance one may opt to eliminate any reinforcement material thus allowing the work to be presented so that both sides of the paint film may be viewed as complete images in themselves; one a monotype, the other a painting. Casting in contrast to printing involves a protracted drying time imposing delays not experienced by artists at the press. While acrylic dries to the touch in a few hours there is less reliability in determining internal drying time. Usually a period of sixteen to twenty-four hours or more, depending on thickness of application and the effects of humidity and temperature on the polymerization process, is required before the print 40 may be safely lifted from the plate, Exposure to heat sources (sun, heat lamp, etc.) will speed drying time; minutes with thinly applied acrylics and one to two hours with moderately thick applications. Thick applications of acrylic gel 26 (especially heavy gels) should be allowed to dry for at least twenty-four hours even when exposed to a heat source.

One may further decide to use the paint film as a source for collage. By cutting into fragments 16 and placing together pieces of the film (either top or bottom surfaces or both) a collage may be composed; and, because these fragmented elements 16 are both flexible and slightly tacky they are actually available to being added to other monotypes in progress simply by pressing them in place on the plate 18. If the fragmented elements 16 should lose their tackiness, then the plate 18 may be first coated with a thin layer of soft gel upon which the elements will adhere, after which a coat of acrylic paint, medium or gel will then hold the element in place permanently. A coat of acrylic paint 22, media or gel 26 will then hold the fragment in place permanently. As is described in greater detail below, this process opens the way for several options. One may prepare in advance a number of plates with images whose sole function is to become available for use in the making of collage. And, of course it follows that fragments may be cut and lifted from any acrylic monotype in progress and either repositioned on the same plate, used on another monotype in progress or placed aside for possible future use. Thus, an entirely new and unique form of collage monotype is made possible.

With regard to the matrix or plate 18, transparent glass, low density polyethylene or transparent polyethylene sheeting have two main advantages:

(1) Transparency allows direct visual examination of the image from its reverse side so that one can judge its progress as well as its final look before it is lifted. It should be noted that no pigment residue will remain on the plate when the print is lifted so that the true appearance and orientation of the image is visible when it is viewed from the plate'reverse side.

(2) Corrections may be made after the acrylic dries by slicing and removing sections of the pigments with breakaway knives or single edge razor blades after which the resulting blank areas may be re-painted. Cutting against glass causes insignificant damage to its surface as compared to that which would be caused against either zinc or polyethelene plate surfaces. Plate glass (¼" thick) is the safest to use as it is less likely to crack or break during its handling. And, in order to avoid injury, its edges should be beveled and its corners rounded slightly.

Two basic steps are required for plate preparation:

(1) Clean both sides of the plate glass. The reverse side should be cleaned so that there is no visual distraction.

(2) Place the plate on a clean sheet of newsprint before beginning work.

At any point in the monotype process one may decide to select a suitable backing material 30 to be attached later to gel painted or squeegeed onto the image after it is completed. Its purpose being to strengthen the acrylic body and facilitate its removal from the plate. Sized papers should be selected because non-sized or waterleaf papers tend to tear apart during the removal process. Any canvas or cloth material may be selected as backing. However, if creases are evident they may present a visual problem in the exposed border areas. For this reason creased fabrics should be soaked in cold water for several hours or more depending on their weight so that they may be stretched afterwards. This is accomplished simply by hanging the fabric until it is slightly damp and then tacking it to a board or wall surface. Shrinkage will tighten and eliminate creasing during drying. Ironing is also an option.

Registration and backing attachment are important for purposes of presentation of the completed monotype 40. It is generally desirable and advantageous for the paper or cloth backing to extend several inches or more beyond the edges of the plate. A simple registration device is as follows with details of backing attachment:

(1) After the plate is placed in the center of a newsprint sheet an outline is drawn around the plate and then another line is drawn indicating the desired location of the backing edges.

(2) The paper or cloth selected is now cut or torn to the dimensions of the backing location lines and then put aside for later placement on the work.

(3) After the image has been completed it must be allowed to dry, at least to touch before a final application of acrylic gel 26. Soft gel is all that is required as an adhesive for the attachment of both light weight and heavy weight cloth or paper backing.

(4) For placement of paper backing locate any paper edge to its corresponding backing location line on the registration device. Holding the paper edge in place then lower it onto the gel coated plate and gently press by hand in order that it makes overall contact. Allow it to dry.

(5) For placement of a cloth backing 30 a cardboard cylinder becomes a practical tool for rolling out loose fabrics. Simply roll the cloth onto the cylinder. Then locate the exposed cloth edge on the appropriate backing registration line and carefully unroll it across the plate. In order to ensure overall contact with the gel, place a sheet of wax paper over the cloth, and, using a roller or brayer gently roll, with light pressure, across the wax paper in at least two different directions. The wax paper may then be carefully removed at a low angle to the cloth. Another easier option when borders are required is to select a plate large enough to contain both the image and its borders. The plate edges can then determine the overall outside dimensions of the artwork.

In regard to backing choices, one may choose between two other options. Cloth or paper may be cut to fit either the exact size of the image or a fraction larger, in which case no registration device is needed, or if the acrylic pigment film is thick enough backing may be eliminated entirely. A paint film 1/64 of an inch thick or more can typically be effectively removed intact. An unreinforced paint film, by its nature, suggests unique presentation solutions in the ways that it may be manipulated and attached to a variety of flat and three dimension surfaces, including those with compound curvatures. Additionally, such a paint film may be mounted on either its outer surface or on its inner contact surface or elements of both if fragmented and collaged. What is suggested here blurs the edges between monotype and other media and introduces the notion of the casting of acrylic pigments, media and gels as a unique addition to the vocabulary of mixed media.

Procedures that are included in the present invention include the following examples.

EXAMPLE 1

In one procedure a layer 14 of acrylic pigment is applied covering partially a matrix surface, allowed to dry and a different color is applied covering the exposed matrix areas. (The first layer acts as a stopout) The whole is then treated as depicted in FIGS. 3–6 and described above.

EXAMPLE 2

In another procedure a dried acrylic pigment layer 14 is scraped or cut away (with a stylus, blade, fingernail, etc.) so that a different color may be applied covering the exposed matrix areas. The whole is then treated as depicted in FIGS. 3–6 and described above.

EXAMPLE 3

Figure 7:
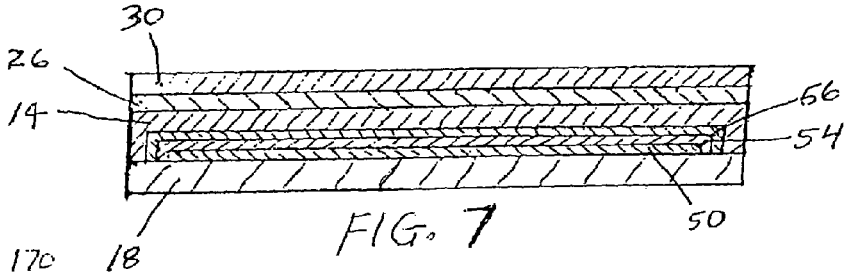
FIG. 7 is a cross-sectional view that is similar to FIG. 4, depicting an artwork having watercolor or other elements therewithin.

In a further procedure as depicted in FIG. 7, a print is created by first painting and/or drawing 50 on the matrix 18 surface with watercolor pigments and/or all other waterbase colors and allowed to dry. Two layers of clear fixative (alcohol base) spray 54 and 56 are then applied; the second layer 56 after the first layer 54 has dried. This traps and bonds the water colors 50 also preventing them from smearing when, subsequently, acrylic pigments 14 and/or 22 are applied as depicted in FIGS. 1 and 2. The whole is then treated as depicted in FIGS. 3–6 and described above.

EXAMPLE 4

In yet another procedure oilbase pigments such as oil pastels, and oilsticks are used as drawing and painting media including the use of mineral spirits to thin and modify the pigments on the matrix surface and then allowed to dry. The resultant image is then painted over with acrylic pigments, such as 14 and 22 of FIG. 1, and then treated as depicted in FIGS. 3–6 and described above.

EXAMPLE 5

In yet a further procedure water mixable oil paints thinned with mineral spirits are applied to the matrix surface and then allowed to dry after which acrylic paint is applied and then treated as depicted in FIGS. 3–6 and described above.

EXAMPLE 6

In still another procedure, a section of an image that has been painted on a matrix surface and then allowed to dry as depicted in FIGS. 1 and 2 and which is approximately 1/64 of an inch or thicker is easily released from the matrix surface by cutting along its borders with a sharp blade and then lifting one edge and then releasing it by hand.

EXAMPLE 7

In still a further procedure, a section of an image after having been lifted from the matrix surface may be placed on a separate blank matrix or other surface for storage for future use, such as for an element 16 as shown in FIGS. 1 and 2.

EXAMPLE 8

In yet another procedure either surface of a removed section (see Example 7) may be repositioned on the same place on the matrix surface or on a different blank image area on the same matrix surface as an element 16 in order to create a collage effect. The result is then treated as depicted in FIGS. 3–6 and described above.

EXAMPLE 9

In yet a further procedure, a section of an image after having been released from one matrix surface may be positioned onto another matrix surface in order to create a collage element on a different image. The result is then treated as depicted in FIGS. 3–6 and described above.

EXAMPLE 10

In still another procedure an image may be created such as a variety of textures on one matrix surface, the sole purpose of which is to be available for repositioning sections on other matrix surfaces. The result is then treated as depicted in FIGS. 3–6 and described above.

The procedures and examples described above may be successfully applied to a matrix surface comprised of paraffin, where the paraffin is preferably applied to a substratum for support. The quality of the substratum upon which paraffin wax may be applied is limited only by practicality; i.e., the desired sub-surface should be smooth and flat. Thus, plastics, metals and paper are practical substrata.

Figure 8:
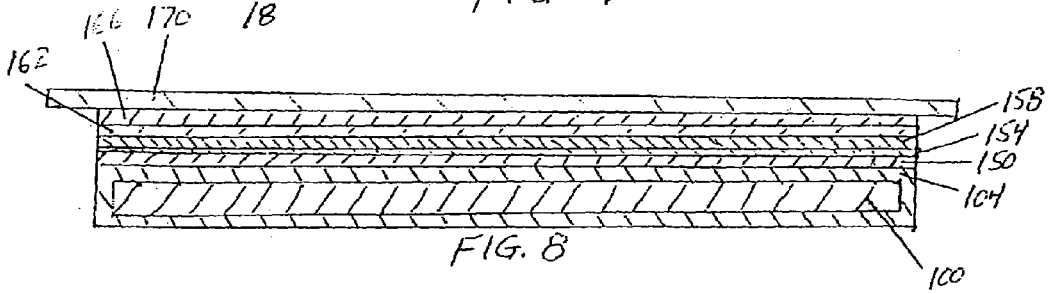
FIG. 8 is a cross-sectional view of a first paraffin matrix.
Figure 9:
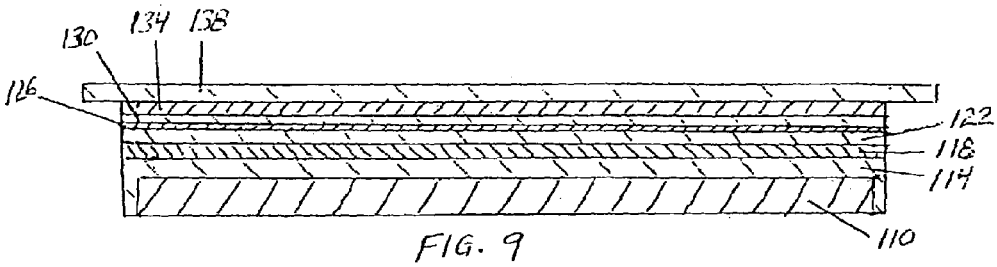
FIG. 9 is a cross-sectional view of a second paraffin matrix.

Two methods of paraffin wax application upon a substrate are next described with the aid of FIGS. 8 and 9.

A. With reference to FIG. 8, the first method applies to the preparation of paper and other thin, flat, flexible materials such as metal foils.

1. A long, narrow metal container (not shown) approximately 6"×6"× the desired paper or foil width dimension is filled with paraffin wax bricks and heated on a stove until the wax has been melted and is a liquid.
2. A sheet of hand held paper or foil 100 is then quickly and steadily drawn through the liquid paraffin and held for a few seconds until dry. The sheet is then ready to receive imagery. Such a sheet 100 with a paraffin coating 104 is depicted in FIG. 8, and its use in an artwork described herebelow.

B. With reference to FIG. 9, the second method of paraffin wax matrix preparation is effective when paraffin is applied to substratum surfaces, such as smooth, flat plastics such as acrylic, styrene and vinyl, as well as glass, papers and smooth, flat metals such as copper, aluminum and steel plates.

1. A hand held paraffin wax brick or brick fragment (not shown) is drawn across a substratum surface 110 until the whole surface is covered with the wax 114.
2. At this point, lumps and skipped areas on the surface may be smoothed and covered by hand rubbing with the aid of a small amount of petroleum jelly. Any remaining jelly may be easily wiped away with a soft, dry cloth. Such a paraffin coated substratum is depicted in FIG. 9 and its use in an artwork is described herebelow.

Both of the above described methods of matrix preparation apply as the fundamental basis of the below described artwork.

EXAMPLE 11

With reference to FIG. 9, such a paraffin matrix is first coated with a transparent acrylic media or gel 118 and allowed to dry. The dry transparent surface now serves as a drawing as well as painting surface for an art piece 122 that may be made using charcoal, pastels and watercolors. This art piece 122 is then sprayed with fixative 126 to prevent future smearing. This surface may be painted on with an acrylic medium 130, or alternatively the transparent surface 118 may be painted on directly with acrylic pigments. When dried the upper surface is then treated as depicted in FIGS. 3–6 and described hereabove; that is, with the application of a wet adhesive gel layer 134 and a backing material 138. When dried the artwork is parted by hand from the paraffin matrix. Typically, the paraffin matrix 114 retains almost none of the transparent acrylic media 118, and it can generally be reused as a matrix many times.

EXAMPLE 12

Figures 10A, 10B, 10C:
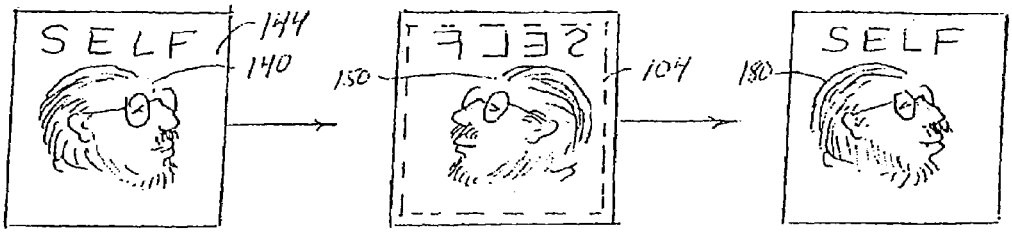
FIGS. 10A, 10B and 10C are related images in an artwork created using a paraffin matrix.

A method of transfer of cursive and printed writing as well as other visual imagery becomes available when using the paraffin matrix, and an example using the paper and metal foil as substrate coated with a paraffin wax matrix, as depicted in FIG. 8, is next described. The process steps are:

1. A drawing 140 (see FIG. 10A) and/or writing on any paper surface 144 is made using a variety of dry pigments such as charcoal, carbon, graphite and pastel. Nearly all grades of these dry pigments, from softest to hardest, are transferable onto paraffin as is next described.
2. The drawing 140 on the paper surface 144 is placed face down on the paraffin wax 104 coated paper 100 and transferred using pressure: either by etching press or by hand pressure using a spoon or a burnishing tool.
3. The drawing paper 144 is then removed and a transferred image 150 (see FIG. 10B) remains on the surface of the paraffin wax matrix 104. The image 150 in the paraffin matrix is the reverse of the drawing 140 or writing. The image 150 is then sprayed with fixative 154 and allowed to dry.
4. The matrix and its image 150 may then be processed as described in Example 11 above. That is, additional acrylic medium 158 and/or paint layers 162 may be applied, and when dry a wet acrylic adhesive gel 166 and backing material 170 are applied and allowed to dry.
5. When the artwork is removed from the paraffin matrix 104, the image 150 will be reversed again, such that the new image 180 (see FIG. 10C) in the removed artwork has been reoriented to that of the original drawing 140.

Figure 11:
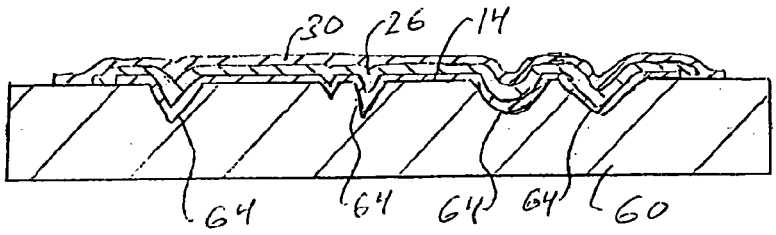
FIG. 11 is a cross-sectional view, similar to FIG. 4, depicting an artwork of the present invention that is formed on a matrix having an uneven surface.

This invention further allows the making of monoprints through the method of cutting, engraving and impressing lines and textures into plate surfaces using blades, wood and linoleum cutting tools as well as the use of selected objects for the purpose of creating textures through the use of pressure. Low density polyethelene plates are most useful for these purposes. As depicted in FIG. 11, the surface of the plate 60 has been cut to create grooves 64. The cut, engraved or impressed areas on the plate are then be filled with acrylic pigment 14 in the process of painting on its surface. After drying, gel 26 is applied and cloth or paper backing 30 is pressed into the gel and allowed to dry. When released from the plate surface the print will be sculptural, having raised ridges that correspond to the grooves 64. The cut, engraved and impressed areas of the plate therefore release the now raised cut, engraved and impressed elements of the artwork, which are three-dimensional in relation to the lower painted surface of the print. The print (a monoprint) has a one-of-a-kind surface image merged with repeatable below the surface elements (intaglio).

EXAMPLE 13

Figure 12:
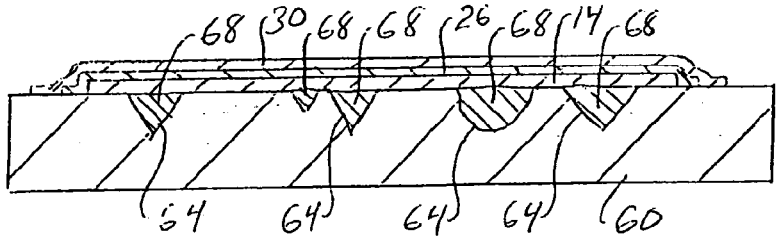
FIG. 12 is a cross-sectional view, similar to FIG. 4, depicting an acrylic intaglio artwork of the present invention.

In still another procedure, as depicted in FIG. 12, this invention allows the making of editionable intaglio prints through the method of filling the cut, engraved and impressed areas 64 of a plate 60 with acrylic pigment 68 and then while still wet, wiping the surface clean with water dampened rags and paper and allowing the submerged acrylic to dry. The plate surface may then be painted with acrylic pigments 14 and then allowed to dry after which acrylic gel 26 is applied and cloth or paper backing 30 is pressed onto the wet gel.

Release of the intaglio print is easily done by hand, thus creating an intaglio print that is capable of being editioned.

EXAMPLE 14

Figure 13:
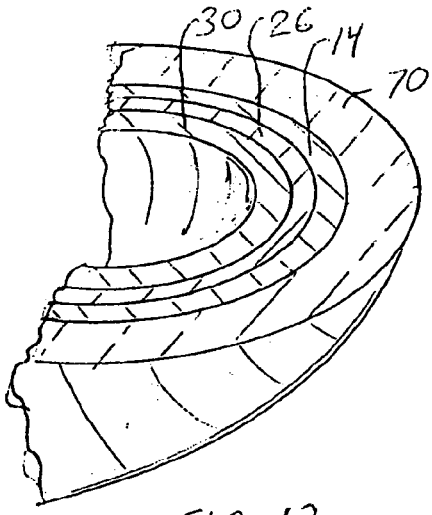
FIG. 13 is a perspective view depicting an artwork of the present invention formed on a three dimensional matrix surface.

Finally, in yet a further procedure, as depicted in FIG. 13, this invention allows the pulling of a monotype from a three-dimensional interior or exterior mold surface 70 such as a bowl or box shape of china, glass or polyethelene material. The same procedures are followed as in the making of two-dimensional prints depicted in FIGS. 1–6 and described in the various examples set forth above. This basically includes applying acrylic paint 14, allowing it to dry, then applying a gel 26 and backing 30, and subsequently removing the dry artwork from the three-dimensional surface.

It is the object of the invention to allow acrylic paints, media and gels to be used according to the intrinsic physical qualities of polymerization, flexibility and bonding ability rather than as poor substitute materials for traditional water-based or oilbased pigments in the producing of fine art monotypes and monoprints as is the case at the present time. As a result of the invention, the drying time of acrylics is no longer a concern for the artist during the process of creating images on the matrix surface. The work, in fact, must dry completely before it may be removed from the matrix.

The invention introduces the concept of casting as opposed to printing in the making of fine art monotypes and monoprints. This approach eliminates the need for the etching press or other mechanical methods of pressure application. Since there are literally tens of thousands of artists who desire to make these single, unique prints but who have either limited access to presses or no access, this invention becomes an avenue toward encouraging the making of monotypes without the need for renting or purchasing a press. The use of acrylics in this new method of making monotypes and monoprints offers a very rich color quality which competes well with traditional media and, in some respects, is superior in its color saturation and in its effect of materiality or body when cast rather than printed. The invention thus encourages the wider and more creative use of acrylics. This cannot but have a positive impact on the marketing of artists acrylics and associated products as well as commercially available acrylic house painting latex, latex enamel and interior/exterior spray paints.

While the present invention has been shown and described with regard to certain preferred embodiments, it is to be understood that those skilled in the art will no doubt devise other and further processes that nevertheless include the true spirit and scope of the present invention. It is therefore intended that the following claims cover all such alterations and modifications in the embodiments described herein that nevertheless include the true spirit and scope of the invention.

What I claim is:

1. A method for making an artwork comprising the steps of:

applying a first layer of acrylic medium upon a paraffin matrix surface and allowing the first layer to dry;

creating an image upon the dry first layer surface using a media including watercolor, charcoal and pastel;

applying a fixative to said media;

applying a second layer of acrylic medium upon said fixative;

drying said second acrylic medium layer;

applying a wet backing material adhesion layer upon an upper surface of said dry second acrylic medium layer;

applying a backing material to said backing material adhesion layer when said backing material adhesion layer is wet;

drying said backing material adhesion layer;

removing said first layer from said matrix surface, such that a surface of said first layer that was dried in contact with said matrix surface is the front surface of said artwork.

2. A method for making an artwork as described in claim 1 including the further steps of:

applying two or more second medium layers of acrylic material upon said fixative prior to applying said backing material adhesion layer, and wherein said backing material adhesion layer is then applied to a dry upper surface of said two or more second layers.

3. A method for making an artwork as described in claim 2 wherein one or more materials selected from the group consisting of paper, fabric, watercolor, ink, oils, and pastels are included within said second acrylic medium layer; and wherein said backing material is comprised of paper or cloth.

4. A method for making an artwork as described in claim 1 including applying an image to a surface of said paraffin matrix prior to applying said first layer of acrylic medium to said paraffin surface.

* * * * *